US009745822B2

(12) United States Patent
Bernard et al.

(10) Patent No.: US 9,745,822 B2
(45) Date of Patent: Aug. 29, 2017

(54) FLAPPER VALVE

(71) Applicants: John L. Bernard, Tusla, OK (US); Michael L. Hair, Tulsa, OK (US)

(72) Inventors: John L. Bernard, Tusla, OK (US); Michael L. Hair, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 115 days.

(21) Appl. No.: 14/661,702

(22) Filed: Mar. 18, 2015

(65) Prior Publication Data

US 2016/0273306 A1 Sep. 22, 2016

(51) Int. Cl.
*E21B 34/00* (2006.01)
*E21B 34/06* (2006.01)

(52) U.S. Cl.
CPC ..... *E21B 34/06* (2013.01); *E21B 2034/005* (2013.01)

(58) Field of Classification Search
CPC ..... E21B 34/005; E21B 34/10; E21B 34/06
See application file for complete search history.

(56) References Cited

U.S. PATENT DOCUMENTS 4,583,596 A * 4/1986 Davis ..... E21B 34/10 137/516.29
4,605,041 A 8/1986 Teumer
4,674,575 A * 6/1987 Guess ..... E21B 34/06 137/516.29
4,771,925 A 9/1988 Stoffler et al.
5,188,182 A * 2/1993 Echols, III ..... E21B 34/063 166/325
6,263,910 B1 * 7/2001 Davis ..... E21B 34/06 137/516.25
6,328,109 B1 * 12/2001 Pringle ..... E21B 23/006 166/321
6,782,916 B2 8/2004 Svendsen et al.
7,178,599 B2 * 2/2007 Anderson ..... E21B 34/102 166/317

(Continued)

FOREIGN PATENT DOCUMENTS

WO 2012112414 A2 8/2012

OTHER PUBLICATIONS

Inernational Search Report and Written Opinion of the International Searching Authority issued on May 13, 2016 in related PCT Application No. PCT/US2016/018463, 12 pages.

(Continued)

*Primary Examiner* — David Bagnell
*Assistant Examiner* — Jonathan Malikasim
(74) *Attorney, Agent, or Firm* — Cantor Colburn LLP

(57) ABSTRACT

A flapper valve includes a valve body having a hinge member. A flapper is pivotally mounted to the valve body through the hinge member. At least one of the valve body and the flapper includes a multi-stage valve seat. The multi-stage valve seat includes a first sealing zone and a second sealing zone that is distinct from the first sealing zone. The first sealing zone is configured to provide pressure containment at the valve body when the flapper is exposed to a first pressure and the second sealing zone is configured to provide pressure containment at the valve body when the flapper is exposed to a second pressure that is greater than the first pressure.

16 Claims, 3 Drawing Sheets

(56) References Cited

U.S. PATENT DOCUMENTS

| | | | | |
|---|---|---|---|---|
| 7,604,056 | B2 * | 10/2009 | Haynes | E21B 34/10 166/316 |
| 8,607,876 | B2 * | 12/2013 | Macrae | E21B 34/06 166/332.8 |
| 8,863,767 | B2 * | 10/2014 | Miller | F16K 15/03 137/15.17 |
| 2005/0012063 | A1 | 1/2005 | Thompson et al. | |
| 2011/0140022 | A1 | 6/2011 | Patterson et al. | |
| 2011/0275882 | A1 | 11/2011 | Hutzenlaub et al. | |

OTHER PUBLICATIONS

Jetseal®, "Jetseal: Engineered Sealing Solutions" (Company Brochure), retrieved from: http://www.jetseal.com/uploads/JetSeal%20Corproate%20Brochure.pdf retrieved on: Aug. 1, 2016, 20 pages.

* cited by examiner

FLAPPER VALVE

BACKGROUND

Many industries employ flapper valves to control fluid flow. The flapper valve includes a flapper that allows fluid flow in one direction and prevents fluid flow in a reverse direction. The flapper is pivotally mounted to the valve and shifts between open and closed configurations. In the closed configuration, the flapper typically rests against a valve seat. In some cases, a seal may exist between the flapper and the valve seat. In other cases, the flapper and valve seat meet at a metal-to-metal interface without the use of an additional seal.

SUMMARY

A flapper valve includes a valve body having a hinge member. A flapper is pivotally mounted to the valve body through the hinge member. At least one of the valve body and the flapper includes a multi-stage valve seat. The multi-stage valve seat includes a first sealing zone and a second sealing zone that is distinct from the first sealing zone. The first sealing zone is configured to provide pressure containment at the valve body when the flapper is exposed to a first pressure and the second sealing zone is configured to provide pressure containment at the valve body when the flapper is exposed to a second pressure that is greater than the first pressure.

A subsurface exploration system includes an uphole system, and a downhole system including at least one downhole tubular. The at least one downhole tubular includes a flapper valve having a valve body including a hinge member, and a flapper pivotally mounted to the valve body through the hinge member. At least one of the valve body and the flapper includes a multi-stage valve seat. The multi-stage valve seat includes a first sealing zone and a second sealing zone that is distinct from the first sealing zone. The first sealing zone is configured to provide pressure containment at the valve body when the flapper is exposed to a first pressure and the second sealing zone is configured to provide pressure containment at the valve body when the flapper is exposed to a second pressure that is greater than the first pressure.

BRIEF DESCRIPTION OF THE DRAWINGS

Referring now to the drawings wherein like elements are numbered alike in the several Figures.

DETAILED DESCRIPTION

Figure 1:
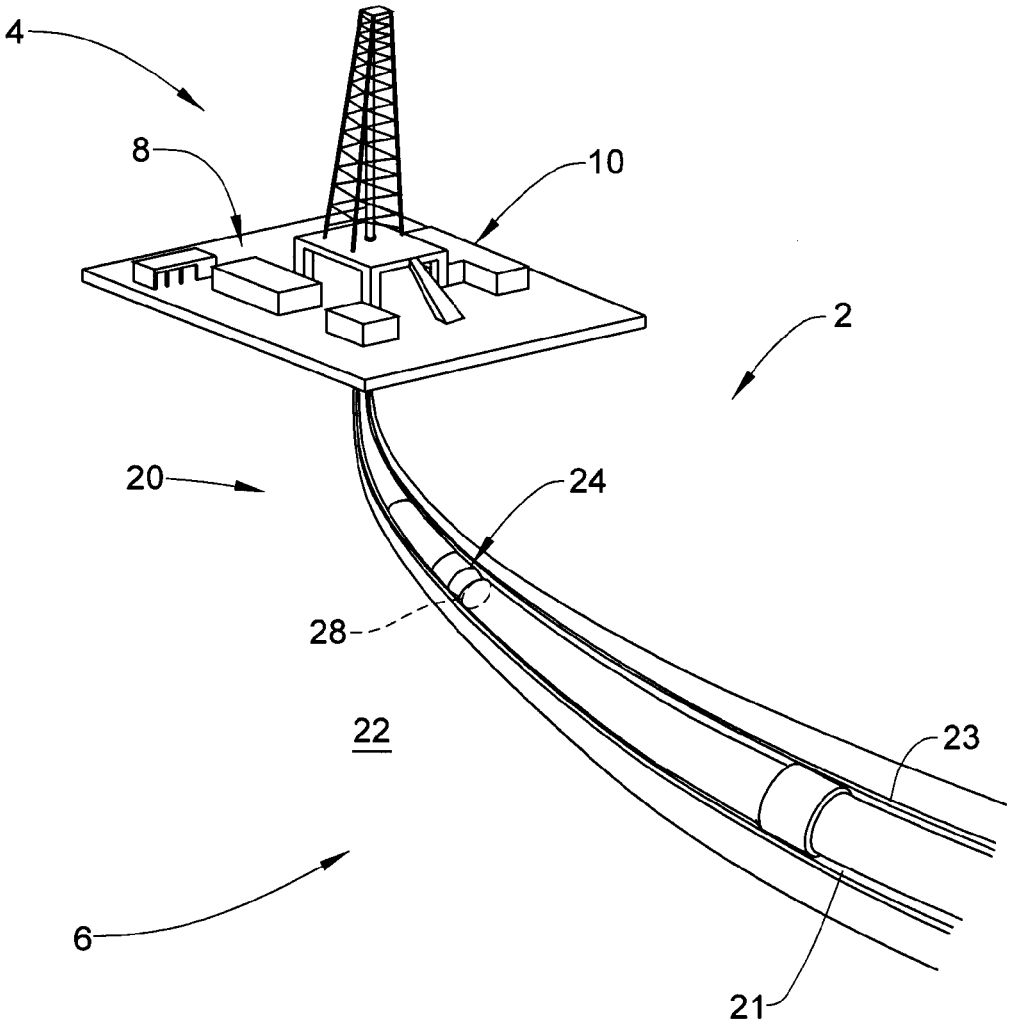
FIG. 1 depicts a resource recovery and exploration system including a downhole tubular having a flapper valve, in accordance with an exemplary embodiment.

A resource exploration system, in accordance with an exemplary embodiment, is indicated generally at 2, in FIG. 1. Resource exploration system 2 should be understood to include well drilling operations, resource extraction and recovery, $CO_2$ sequestration, and the like. Resource exploration system 2 may include an uphole system 4 operatively connected to a downhole system 6. Uphole system 4 may include pumps 8 that aid in completion and/or extraction processes as well as fluid storage 10. Fluid storage 10 may contain a completion fluid that is introduced into downhole system 6. Downhole system 6 may include a downhole string 20 that is extended into a wellbore 21 formed in formation 22. Wellbore 21 may include a wellbore casing 23. Downhole string 20 may include a number of connected downhole tools or tubulars 24. One of tubulars 24 may include a flapper valve 28. While shown as being part of tubular 24, it should be understood that flapper valve 28 may be employed in a wide variety of applications and should not be considered to be restricted to resource exploration and/or recovery.

Figure 2:
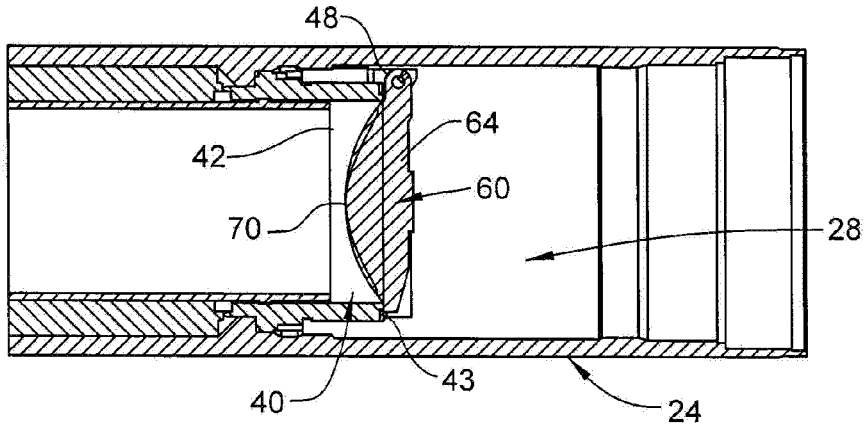
FIG. 2 depicts a partial cross-sectional side view of the downhole tubular and flapper valve of FIG. 1.
Figure 3:
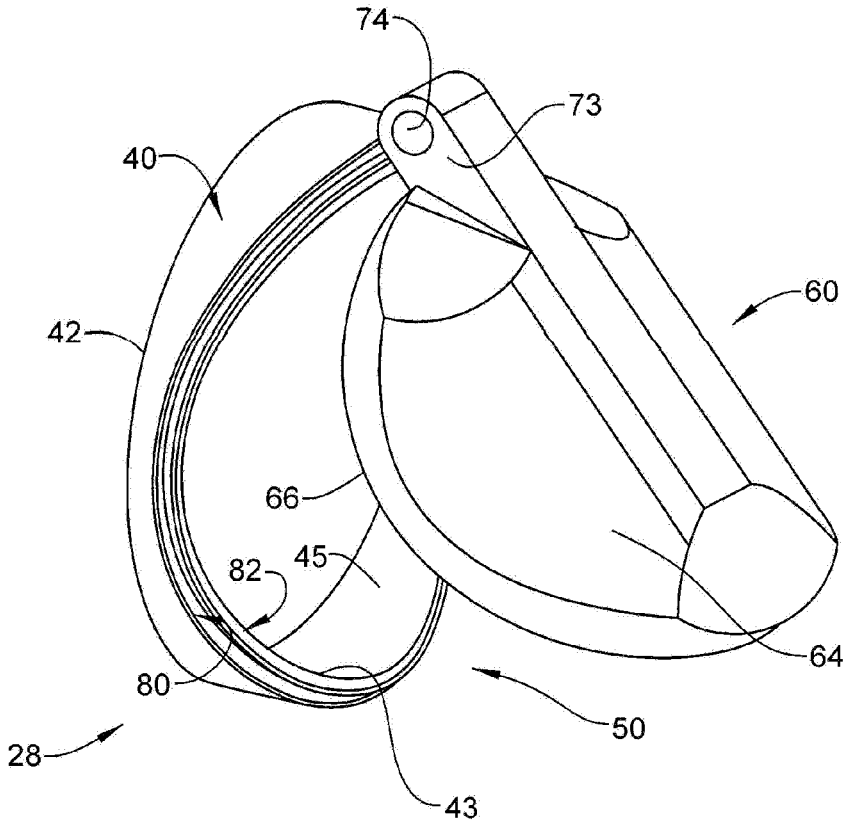
FIG. 3 depicts the flapper valve of FIG. 2 in an open configuration.
Figure 4:
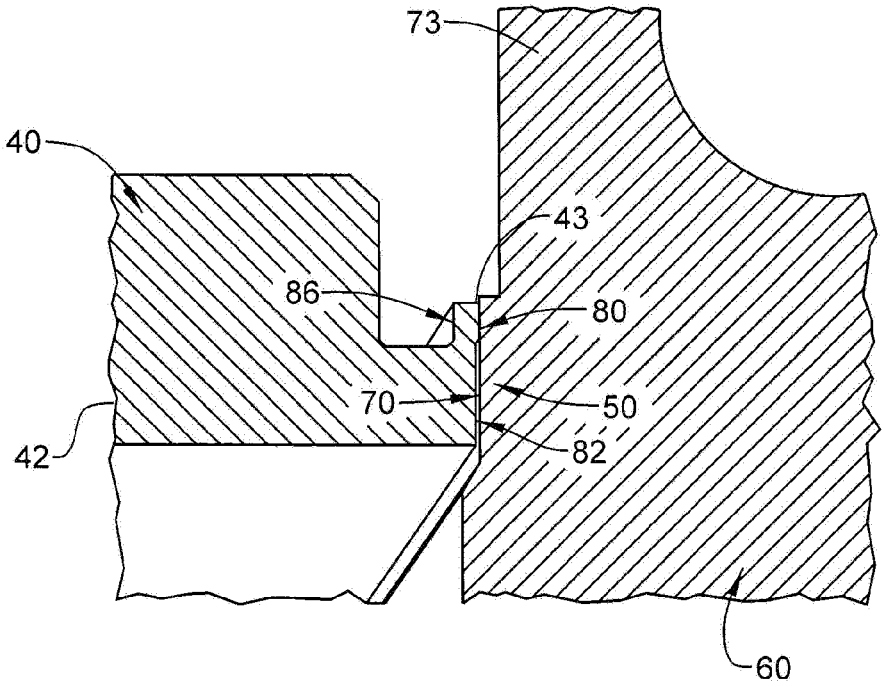
FIG. 4 depicts a detailed partial cross-sectional view of a multi-stage valve seat of the flapper valve, in accordance with an exemplary embodiment.

As shown in FIGS. 2-4, flapper valve 28 includes a flapper seat or valve body 40 having a first end 42 coupled to tubular 24 and a second end 43 defining an opening 45. Opening 45 extends from first end 42 to second end 43 providing a fluidic pathway through valve body 40. Valve body 40 also includes a hinge member 48 arranged at second end 43 and, as will be detailed more fully below, a multi-stage valve seat 50. Flapper valve 28 also includes a flapper 60 pivotally mounted to valve body 40. Flapper 60 includes a first surface 64 and an opposing, second surface 66 that covers opening 45. Second surface 66 also includes a sealing surface 70 that mates with multi-stage valve seat 50 to prevent fluid passing through flapper valve 28 when flapper 60 is closed. Flapper 60 also includes a hinge element 73 that is pivotally connected to hinge member 48 through a hinge pin 74. In accordance with an aspect of an exemplary embodiment, multi-stage valve seat is integrally formed with valve body 40. However, it is to be understood that the multi-stage valve seat may be integrally formed with flapper 60.

In accordance with an exemplary embodiment, multi-stage valve seat 50 includes a first sealing zone 80 and a second sealing zone 82. As will be detailed more fully below, first sealing zone 80 is formed on a cantilevered region 86 of multi-stage valve seat 50. Second sealing zone 82 is arranged radially inwardly of first sealing zone 80 at second end 43 of valve body 40. Second sealing zone 82 is also axially off-set relative to first sealing zone 80. More specifically, second sealing zone 82 is closer to first end 42 of valve body 40 than first sealing zone 80.

In further accordance with an exemplary embodiment, first sealing zone 80 constitutes a low pressure sealing zone creating a seal at low pressures at about, for example 200-psi (14.1 kgf/cm$^2$). More specifically, a pressure of about 200-psi on flapper 60 urges sealing surface 70 against first sealing zone 80 providing pressure containment and/or preventing fluid passing through valve body 40. Second sealing zone 82 constitutes a higher pressure sealing zone. Pressures above about 200-psi, such as working pressures, acting upon first surface 64 of flapper 60 may cause first sealing zone 80 to elastically deform such that sealing surface 70 also contacts second sealing zone 82 providing additional pressure containment and/or ensuring that fluids do not pass through valve body 40.

At this point it should be understood that exemplary embodiments describe a flapper valve having at least two sealing surfaces, a low pressure sealing surface, and a higher pressure sealing surface. The low pressure sealing surface elastically deforms at higher pressures to provide a more robust closure of the flapper valve. It should also be understood, that while shown as being part of the valve body, the multi-stage valve seat may be formed on the flapper. Further, it should be understood that while shown as being employed in downhole operations, it should be understood that the flapper may be employed in a wide variety of applications in which multi-stage sealing is desirable and should not be considered to be limited to downhole environments, or resource recovery and exploration operations.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers, etc.

The term "about" is intended to include the degree of error associated with measurement of the particular quantity based upon the equipment available at the time of filing the application. For example, "about" can include a range of ±8% or 5%, or 2% of a given value.

While one or more embodiments have been shown and described, modifications and substitutions may be made thereto without departing from the spirit and scope of the invention. Accordingly, it is to be understood that the present invention has been described by way of illustrations and not limitation.

What is claimed is:

1. A flapper valve comprising:

a valve body including a hinge member; and a flapper pivotally mounted to the valve body through the hinge member, wherein the valve body includes a one-piece multi-stage valve seat integrally formed with the valve body, the one-piece multi-stage valve seat including a first sealing zone and a second sealing zone that is distinct from the first sealing zone, the first sealing zone being cantilevered from the second sealing zone and configured to provide pressure containment at the valve body when the flapper is exposed to a first pressure and the second sealing zone being configured to provide pressure containment at the valve body when the flapper is exposed to a second pressure that is greater than the first pressure.

2. The flapper valve according to claim 1, wherein the one-piece multi-stage valve seat is arranged on the valve body.

3. The flapper valve according to claim 1, wherein the first sealing zone is radially off-set relative to the second sealing zone.

4. The flapper valve according to claim 3, wherein the first sealing zone is arranged radially outwardly of the second sealing zone.

5. The flapper valve according to claim 1, wherein the first sealing zone is axially off-set relative to the second sealing zone.

6. The flapper valve according to claim 5, wherein the second sealing zone is arranged axially inwardly of the first sealing zone.

7. The flapper valve according to claim 1, wherein the first sealing zone is elastically deformable relative to the valve body.

8. The flapper valve according to claim 1, wherein the first pressure is about 200-psi (14.1 kgf/cm$^2$).

9. A resource exploration system comprising:

an uphole system; and a downhole system including at least one downhole tubular, the at least one downhole tubular including a flapper valve comprising:

a valve body including a hinge member; and a flapper pivotally mounted to the valve body through the hinge member, wherein the valve body includes a one-piece multi-stage valve seat integrally formed with valve body, the one-piece multi-stage valve seat including a first sealing zone and a second sealing zone that is distinct from the first sealing zone, the first sealing zone being cantilevered from the second sealing zone and configured to provide pressure containment at the valve body when the flapper is exposed to a first pressure and the second sealing zone being configured to provide pressure containment at the valve body when the flapper is exposed to a second pressure that is greater than the first pressure.

10. The resource exploration system according to claim 9, wherein the one-piece multi-stage valve seat is arranged on the valve body.

11. The resource exploration system according to claim 9, wherein the first sealing zone is radially off-set relative to the second sealing zone.

12. The resource exploration system according to claim 11, wherein the first sealing zone is arranged radially outwardly of the second sealing zone.

13. The resource exploration system according to claim 9, wherein the first sealing zone is axially off-set relative to the second sealing zone.

14. The resource exploration system according to claim 13, wherein the second sealing zone is arranged axially inwardly of the first sealing zone.

15. The resource exploration system according to claim 9, wherein the first sealing zone is elastically deformable relative to the valve body.

16. The resource exploration system according to claim 9, wherein the first pressure is about 200-psi (14.1 kgf/cm$^2$).

* * * * *